US006456241B1

(12) United States Patent
Rothe et al.

(10) Patent No.: US 6,456,241 B1
(45) Date of Patent: Sep. 24, 2002

(54) WIDE BAND PLANAR RADIATOR

(75) Inventors: Ing Habil Lutz Rothe, Halle; Walter Gerhard, Neidlingen, both of (DE)

(73) Assignee: Pates Technology, Lubeck (DE)

( * ) Notice: Subject to any disclaimer, the term of this patent is extended or adjusted under 35 U.S.C. 154(b) by 0 days.

(21) Appl. No.: 09/402,001

(22) PCT Filed: Mar. 25, 1998

(86) PCT No.: PCT/EP98/01757

§ 371 (c)(1),
(2), (4) Date: Jul. 6, 2000

(87) PCT Pub. No.: WO98/26642

PCT Pub. Date: Jun. 25, 1998

(30) Foreign Application Priority Data

Mar. 25, 1997 (DE) ..... 197 12 510

(51) Int. Cl.[7] ..... H01Q 1/38

(52) U.S. Cl. ..... 343/700 MS; 343/770; 343/767

(58) Field of Search ..... 343/700 MS, 767, 343/770, 814, 771, 756, 768

(56) References Cited

U.S. PATENT DOCUMENTS

| | | | | |
|---|---|---|---|---|
| 4,926,189 A | * | 5/1990 | Zaghloul et al. | 343/700 MS |
| 4,929,959 A | * | 5/1990 | Sorbello et al. | 343/700 MS |
| 5,005,019 A | * | 4/1991 | Zaghloul et al. | 343/700 MS |
| 5,321,411 A | * | 6/1994 | Tsukamoto et al. | 343/700 MS |
| 5,453,751 A | * | 9/1995 | Tsukamoto et al. | 343/700 MS |
| 5,534,877 A | * | 7/1996 | Sorbello et al. | 343/700 MS |
| 5,661,494 A | * | 8/1997 | Bondyopadhyay | 343/700 MS |

FOREIGN PATENT DOCUMENTS

| | | |
|---|---|---|
| EP | 0 123 359 A1 | 4/1984 |
| EP | 0 262 779 A1 | 6/1987 |
| EP | 0 520 908 A1 | 6/1992 |
| EP | 0 542 447 A1 | 10/1992 |
| FR | 2 625 616 A1 | 12/1988 |

* cited by examiner

*Primary Examiner*—Don Wong
*Assistant Examiner*—Shih-Chao Chen
(74) *Attorney, Agent, or Firm*—Woodbridge & Associates, P.C.; Richard C. Woodbridge

(57) ABSTRACT

The present radiator pertains to a planar array antenna for sending or receiving linear polarized waves, with two radiator levels each comprising radiator elements mounted in lines and columns, while the elements of each radiator level are coupled on a central point so as to be equal in phase and amplitude. Both radiator levels receive and transmit mutually perpendicular polarized waves, and each radiator element has shades (6) and a linear excitrated stripline (16, 16[1], 16*a*, 16*b*). Said striplines (16, 16[1], 16*a* 16*b*) are linked in pairs to the branch ends (15, 31) of the coupling networks (1, 2), and the striplines (16, 16[1], 16*a* 16*b*) of each pair are mounted on the axis or arranged in an axially parallel configuration; the free ends of both striplines (15, 16[1], 16*a*, 16*b*) are connected through at least one connection line (32, 33, 34, 36) to a brunch end (15, 31), and a 180° phase difference between both radiator elements (6,16) is obtained by using at least one connection line (32, 33, 34) of a stripline (16, 16[1], 16*a*, 16*b*).

26 Claims, 9 Drawing Sheets

WIDE BAND PLANAR RADIATOR

BACKGROUND OF THE INVENTION

1. Field of the Invention

This invention concerns a planar array antenna for receiving and transmitting linearly polarized waves having two parallel radiator planes, each with several radiator elements arranged in rows and columns, with the radiator elements of each radiator plane being coupled over a coupling network to a central point having the same amplitude and phase, and the two radiator planes receive or emit waves polarized perpendicular to one another.

2. Description of Related Art

The planar array antenna is designed as a radiator system for directional reception of extra-high frequency electromagnetic radiation fields on the basis of a planar invention concept by means of which directional information transmission systems can be operated, preferably in the areas of satellite-supported data transmission, audio transmission and video transmission. This invention primarily concerns the design of the individual radiators and their coupling to the network.

The scope of this invention also includes stationary and mobile telephone and information transmission based on satellite-supported communications transmission and the sector of terrestrial information transmission on the basis of defined point-to-point connections. Primary targeted application areas here include in particular the field of satellite-supported analog and digital signal transmission, preferably within the spectral range between 10.70 GHz and 12.75 GHz, as well as the field of terrestrial point-to-point transmission, preferably within the spectral range between 10.00 GHz and 10.40 GHz.

Planar radiator designs known at the present for reception of high-frequency electromagnetic radiation fields are based on electromagnetic excitation of slot fields with rectangular, square, circular or rhombic slot borders which are supplied electromagnetically by means of striplines with defined geometric dimensions.

The combination of an alternating arrangement of excited strip transmission lines or excited slots and the respective design of the slot contour determines the characteristics of the electromagnetic radiation field that can be generated. The known arrangements are based on generation of circularly polarized electromagnetic radiation fields by means of groups of slots energized in phase, with the individual slots being energized with a mutual offset of 90° in space and time by means of pair of striplines with defined geometric dimensions, or they are based on generation of linearly polarized electromagnetic radiation fields by means of groups of slots energized in phase, with the individual slots being energized by means of a stripline with defined geometric dimensions, whose geometric arrangement determines the direction of vibration of the electric field vector. Known implementations of the design of the radiator elements have also been based on the use of conductor surfaces with defined geometric dimensions, consisting of one or more of the same or different surface elements galvanically linked or linked in a field-supported manner and having area edges in the form of a square, rectangle, circle or trapezoid, leading to energization of the slot fields, with the polarization being determined on the basis of the location of the signal input.

Implementations going beyond this have been based on the configuration of surface resonators in microstrip technology or coplanar technology having a square, rectangular or circular surface bordering. Both galvanic and field-supported embodiments of signal input are known here. Additional known implementations have been based on microstrip configurations in ring designs or frame designs with a resonant geometric ring length or frame length. The known implementations of the excitation networks for the case of the group arrangement are based on parallel power supply to the radiator elements or parallel power supply to series-supplied radiator subgroups. Microstrip technology, slotline technology, triplate technology or coplanar technology may be used for the implementation of these coupling networks.

Generation of two orthogonal polarizations is based on the known status of the manner of arranging the radiator elements along the surface normals of the slots or surface resonators. Known planar directional radiator arrangements with a high directional effect are configured exclusively as narrow band systems or, for the case of satellite-supported information transmission, they are configured as single-band systems. Signal input and output take place in a known manner by way of a hollow conductor with a capacitive probe, with the hollow conductor geometry imaging the propagation condition of the type of field of the highest cut-off wavelength.

SUMMARY OF THE INVENTION

The goal of this invention is the configuration of planar transmission and reception modules by means of which directional information transmission links, both direct and transponder-supported, can be designed within the framework of the mobile terrestrial telecommunications and information transmission sector using satellite-supported telecommunications lines.

The object of the present invention is therefore to provide a planar array antenna whose geometric dimensions are as small as possible, with the antenna having the broadest possible spectral band with a high surface efficiency and a high directional effect.

This object is achieved according to this invention by a planar array antenna having the features of claim 1. Additional advantageous embodiments are derived from the features of the subordinate claims.

The planar array antenna according this invention advantageously has square slots which have a much greater broad-band effect and a greater polarization purity in comparison with round slots. However, square slots have the disadvantage that they require more electromagnetic coupling plus the fact that adjacent radiator elements mutually influence one another. Furthermore, square slots take up more space, which has a negative effect on implementation of the power supply system. This is due to the fact that only the striplines of the coupling network energizing the slots can extend into the slot space, and the coupling network which connects the excited striplines to the coupling point cannot extend into the slot space. Therefore, a square slot with rounded corners is used as the optimum between electric broad band properties and the required geometric space requirements. Square or rectangular slots with other conceivable shaping of the corners or sides are also possible.

The individual radiator is energized by means of a piece of conductor projecting into the slot. The shape of the conductor, the shape of the borders of the slots and the position of the conductor relative to the slot determine the base point impedance of the "slot-conductor" radiator element. The radiator elements are connected at the proper impedance and in the same phase and amplitude by a power supply or coupling network which is also planar, and they are led to a common summation point (coupling point) . A parallel power supply between individual radiators is generally used here. However, this is not appropriate with individual radiators having a square slot shape due to the lack of space. Due to the need for coupling of individual radiators at the proper impedance and with low reflection and the need for impedance transformation, this yields corresponding conductor widths that largely rule out the practical implementation options. Therefore in the state of the art, at least two power supply lines must be provided between two slots, which leads to considerable electrical and mechanical problems and makes practical implementation virtually impossible.

This fundamental problem is solved with the present invention by using a new serial power supply technology between two adjacent radiator elements. Due to the serial power supply, it is possible to design the entire power supply system in a mechanically simplified manner while also solving the space problem in providing power to square slots. Furthermore, the electric properties of the power supply line are greatly improved, because there are no power supply lines running in parallel between the slots, and consequently there cannot be any electromagnetic coupling phenomena which would have a negative effect on the entire functioning of the system.

The power supply to the slots is provided through line segments arranged in alternation in the plane of the electric polarization (e-plane). Thus, all the radiator elements are always aligned and polarized in phase opposition by 180°. To guarantee in-phase power supply to all elements, a 180° phase difference is produced by phase inversion between two adjacent slots. This form of power supply also has the advantage that energized parasitic waves that are capable of propagation and occur due to asymmetries in energization of the slot by the triplate power supply line are largely eliminated by the serial power supply, and their negative effects on the electric functioning are greatly reduced. The advantageous combination of square slot with rounded corners and serial power supply leads to very good electric characteristics with regard to the polarization purity, insulation, front-to-back ratio and area efficiency.

The energized striplines serve to energize a type of field or vibration within the slot which is determined by the geometry and contour of the slot as well as by the geometric position and geometry of the excited stripline. This means that the design of the resulting type of field or radiation from the slot is determined by the superimposing the source condition or energization condition determined by the arrangement and geometry of the stripline on the propagation or existence condition which is determined by the contour and geometry of the slot. The field type generation of the polarization state of the slot field is determined by the specific generation of a defined impedance profile within the slot space by means of the dimensions of the excited stripline in terms of both geometry and arrangement, so that both orthogonal linear polarization and orthogonal circular polarization are generated for the case of the same slot contour. As a complementary measure, for the case of identical energization elements, i.e. the same excited striplines, the design or existence conditions of orthogonal linear polarization as well as orthogonal circular polarization are produced by means of controlled generation of defined slot elements within the slot space by means of the contour or geometric design of the slot. Linear polarization can be converted to circular polarization by means of an additional polarizer.

To maintain the broad-band characteristic of the individual radiator and the power supply network, a broad-band frequency coupling between the common power distribution of the antenna and the downstream electronic system (LNC) is needed. The planar array antenna according to this invention has an adapted, low-reflection, broad-band frequency transmission from a coaxial line to a triplate line. The problem with this type of coupling is the implementation of an extra-high-frequency ground connection between the external coaxial conductor (ground) and the two ground lines of a triplate line with coupling at the rear. This problem has been solved by using a hollow profile segment. A good ground connection between the hollow profile segment, the slot masks and the coaxial input or output is crucial. The "hollow profile" or "tunnel" thus formed is selected so as to permit output of the antenna signal power with the lowest possible reflection. The external form of the hollow profile segment is irrelevant for the electric properties and is determined on the basis of manufacturing factors. Thus, any desired number of mechanical hollow profile segment shapes are conceivable. The object of the present invention is explained in greater detail below together with additional embodiments thereof, as described in the following drawings also.

DETAILED DESCRIPTION OF THE PREFERRED EMBODIMENT

Figure 1:
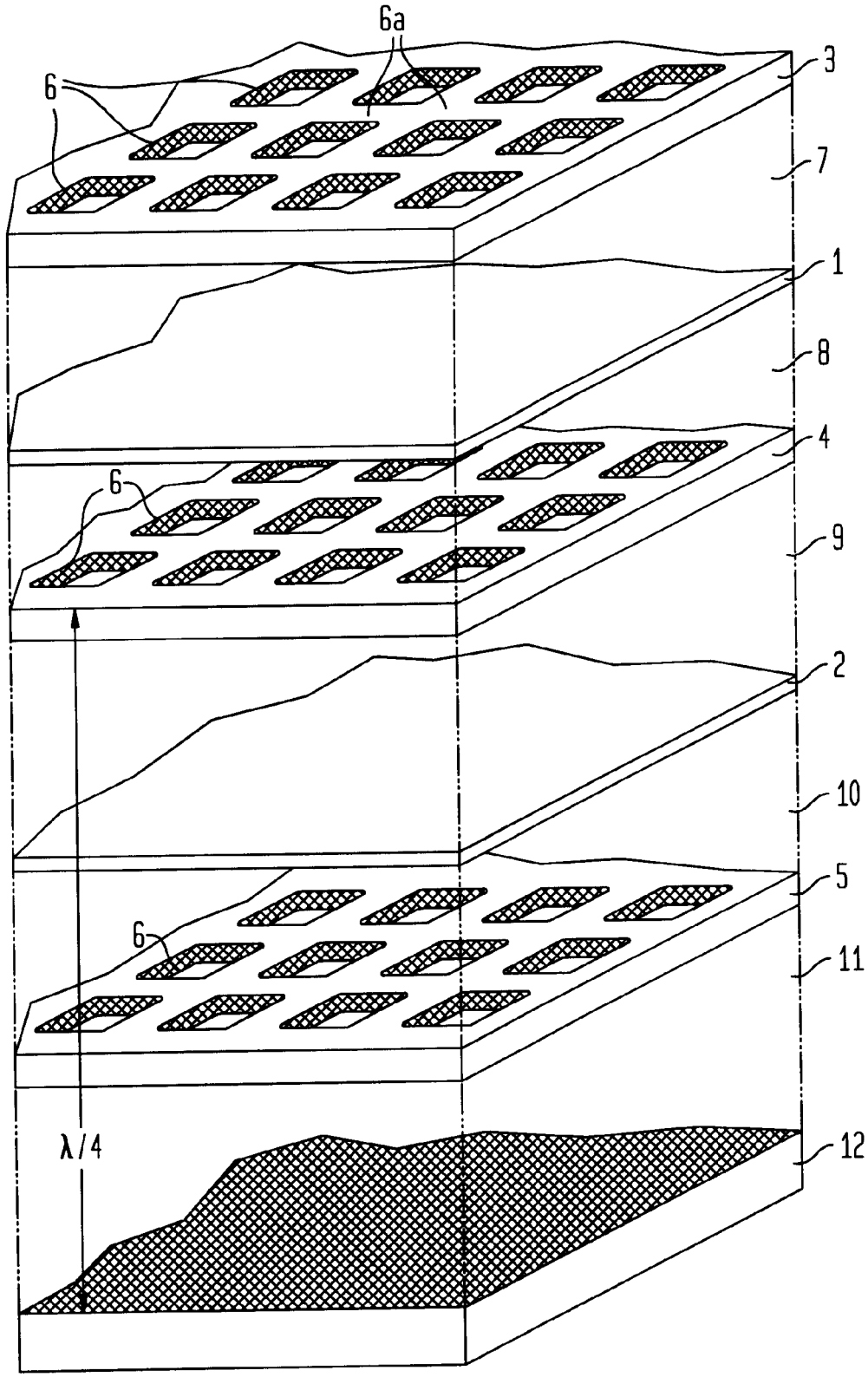
FIG. 1: a perspective sectional drawing through the planar array antenna according to this invention.
Figure 2:
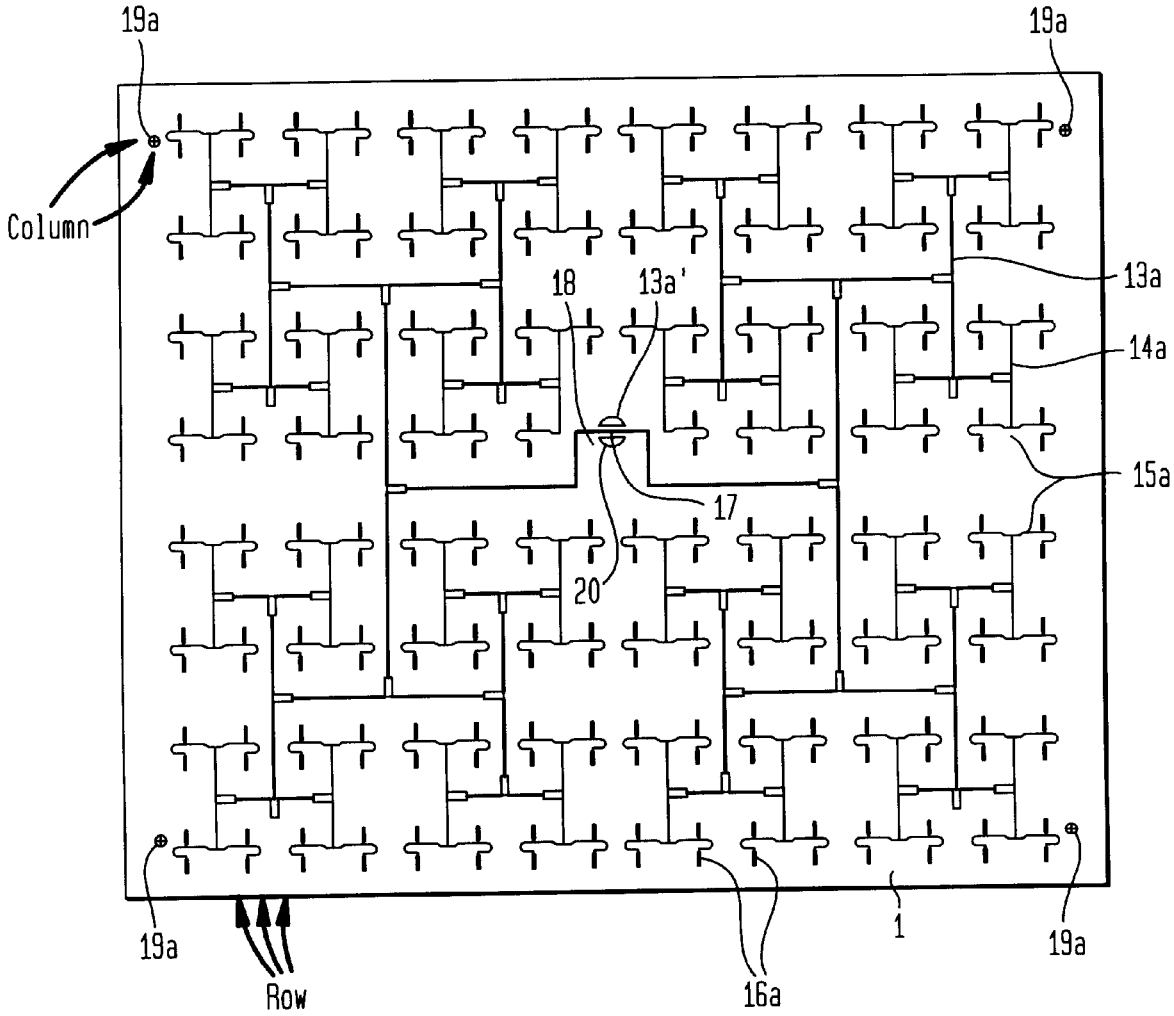
FIG. 2, 3: the coupling networks of the planar array antenna.
Figure 3:
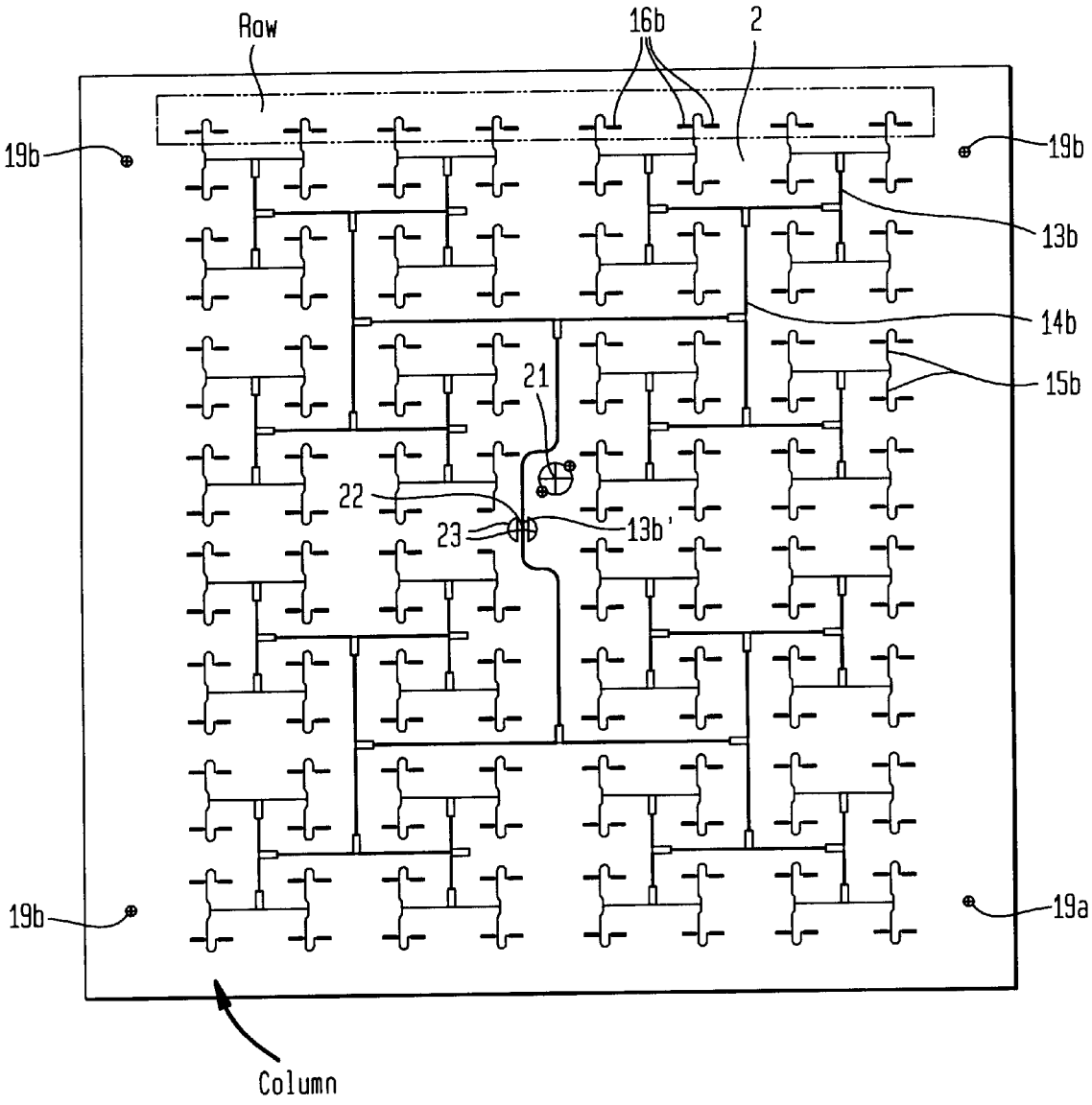
Figure 5:
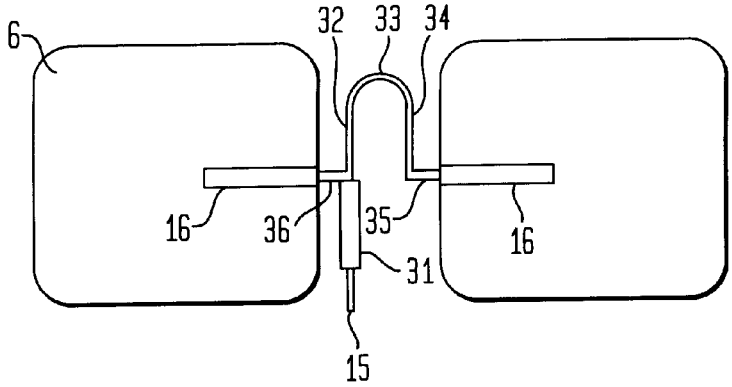
FIG. 5: two adjacent slots together with the striplines energizing them, projecting with central symmetry into the slot space.
Figure 6:
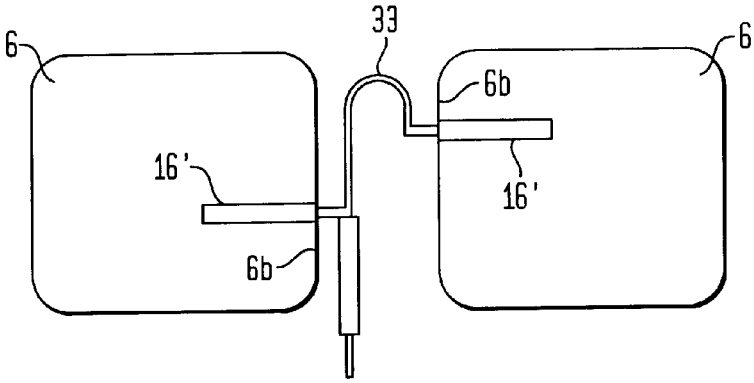
FIG. 6: two adjacent slots with excited striplines projecting into the slot space without symmetry of their centers.

FIG. 1 shows a perspective detail drawing of the planar array antenna according to this invention, with the three conductive layers (slot masks) 3, 4 and 5 with the coupling networks 1 and 2 as well as the baseplate 12 being arranged plane-parallel to one another. Slots 6 of the conductive layers 3, 4, 5 are arranged one above the other, together forming the slot spaces which are energized by the coupling networks shown in FIGS. 2 and 3 and in particular by the excited striplines 16*a* and 16*b* in the form of strips. Baseplate 12 is located at a distance of approximately $\lambda/4$ from the conductive layer 4 and serves to shield and reflect the radiation emitted in the direction of baseplate 12. The interspaces between the conductive layers 3, 4 and 5 and the baseplate 12 and the coupling networks 1 and 2 are filled by dielectric layers 7, 8, 9, 10 and 11, with the dielectric layers being made of films or mats and placed in position between the individual layers. The conductive layers 3 and 4 together with their slots 6 and the coupling network 1 form n×m radiator elements. The conductive layers 4 and 5 with their slots 6 together with coupling network 2 likewise form nxm radiator elements. As shown in FIGS. 2 and 3, all the excited striplines 16*a* and 16*b* are coupled by the coupling networks in the same phase and amplitude to a central coupling point 17 or 22 within the network plane. Each coupling network consists of trunk branches 13*a'* and 13*b'* to which additional branches 13*a*, 13*b*, 14*a*, 14*b* are connected. The last branch of the network before reaching the excited striplines is referred to below as a branch. As shown in FIG. 5, the first excited stripline 16 is connected to this branch 15, 31 by a short connecting line 36. A U-shaped connecting line 32, 33, 34 is also connected to branch 15, 31 with one leg 32, the other leg 34 being connected at a right angle to the second excited stripline 16 by an additional short connecting line 35. The two excited striplines 16 connected to branch 15, 31 together form a group of two. Stripline 16*a* of coupling network 1 and stripline 16*b* of coupling network 2, each lying on a line, together form one row of a coupling network. The striplines which are arranged parallel to one another each form a column. As shown in FIG. 6, it is also possible for the striplines 16' forming a group of two not to be arranged on one row but instead to be axially parallel to one another. This determines the energization or impedance of the planar array antenna.

The geometric length and the arrangement in terms of the coupling profile of the U-shaped connecting line 32, 33, 34 are designed so that the condition of phase opposition is created between the first and second row slots, the third and fourth row slots, the fifth and sixth row slots, etc., taking into account the mutual slot coupling in the plane of the electric field vector.

The connecting line 32, 33, 34 that serves the function of the 180° phase shift need not be U-shaped but instead may have any other desired shape and form. However, the U shape has great advantages in terms of the space required.

The excited striplines 16*a*, 16*b* are arranged with center symmetry (FIG. 5) or without center symmetry (FIG. 6), preferably with center symmetry with the one edge 6*b* of slot 6. Striplines 16*a*, 16*b* run perpendicular to one another. This yields the possibility of generating decoupled orthogonal linear polarization or the possibility of generating coupled and phase-offset orthogonal polarization or circular polarization with opposite directions of rotation of the field vector.

Figure 7:
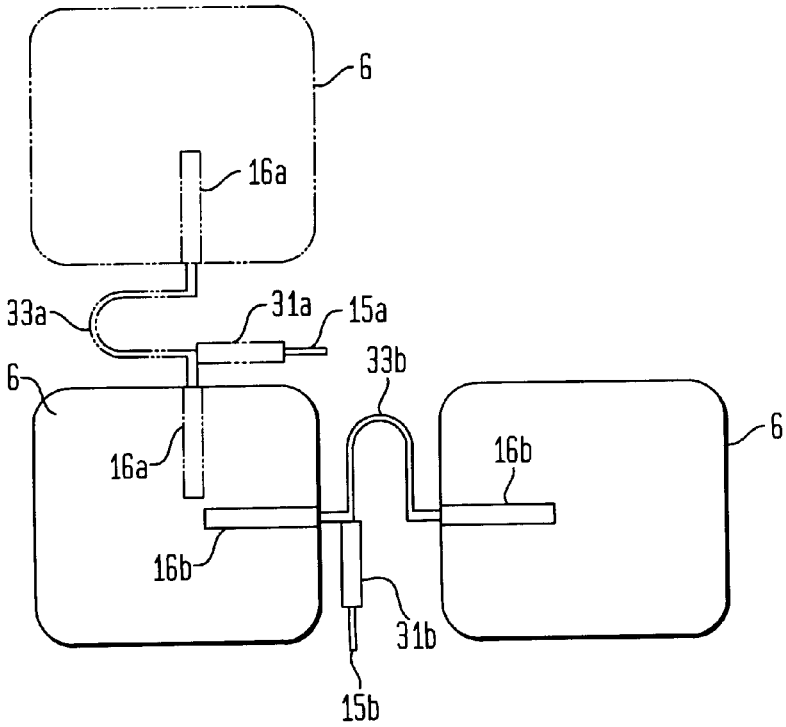
FIG. 7: the two coupling networks superimposed, together with a diagram of the slot spaces.

As FIG. 7 shows, the individual excited striplines 16*a*, 16*b* of coupling networks 1 and 2 are arranged orthogonal to one another so that two orthogonally polarized waves can be sent and received by means of the planar array antenna according to this invention.

Figure 8:
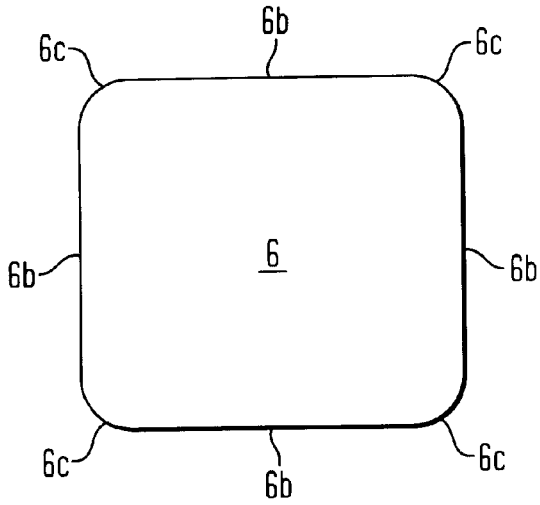
FIG. 8–10: examples of slot shapes.
Figure 9:
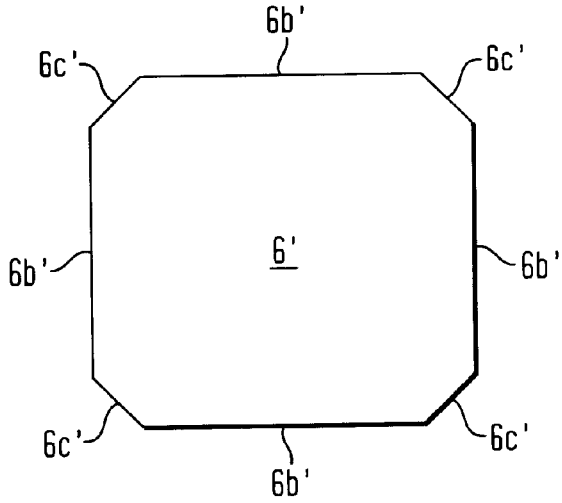
Figure 10:
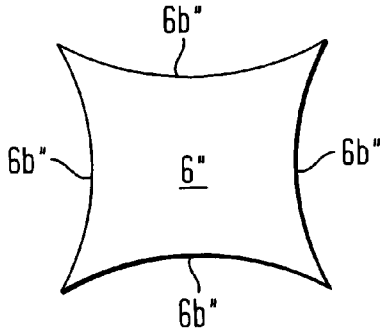

FIGS. 8 through 10 show different slot edges. FIG. 8 shows a square slot 6 with straight edges 6*b* connected to one another by means of arc-shaped segments 6*c*. FIG. 9 also shows a square slot 6' with the corners 6*c'* being chamfered.

Another possibility of varying or adjusting the broad-band characteristic of the planar array antenna by means of the slot borders is illustrated in FIG. 10, where the edges 6*b''*are not straight but instead they are indented in a circular, elliptical or hyperbolic shape.

Figure 4:
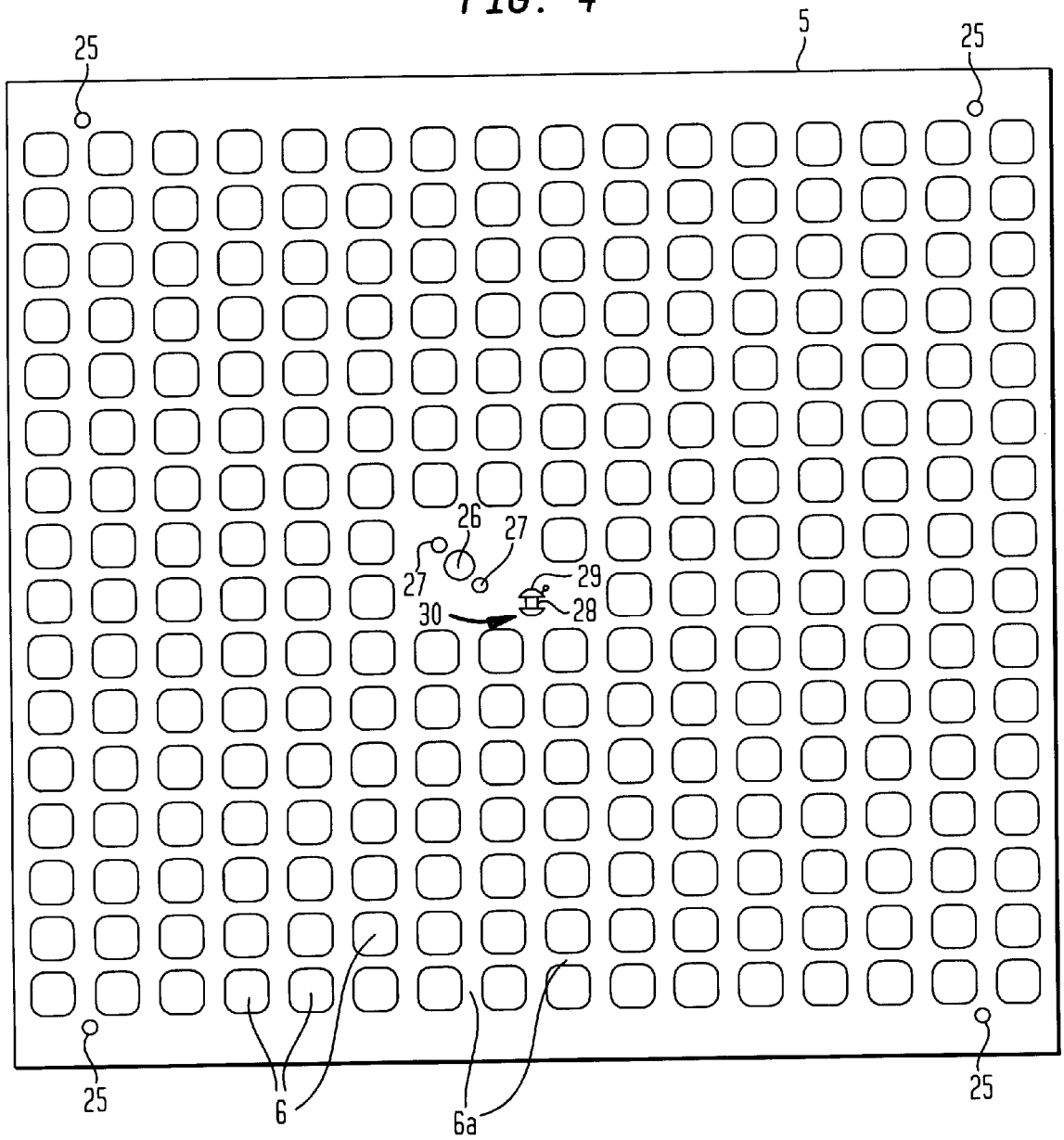
FIG. 4: a conductive layer with slots arranged in the form of a matrix.

Slot 6 of the individual conducting layers 3, 4 and 5 are each arranged relative to one another in such a way that the points of intersection of their lines of symmetry are arranged one above the other. As shown in FIG. 4, the slots 6 of one plane are arranged at equal distances from one another. However it is also possible for the slots to be arranged at unequal distances from one another in a plane. The slots may also be arranged so they are shifted in rows or columns relative to one another.

The dielectric layers 7, 8, 9, 10 and 11 may have the same or different susceptibility profiles. The individual layers may either be homogeneous or they may be configured using more than one partial layer with the same or different layer height, preferably the same layer height, and the same or different dielectric susceptibility profile, preferably the same dielectric susceptibility profile. The coupling network is either carrier-free or is guided mechanically and stabilized by means of a layer having a low dielectric constant, preferably a low-dielectric film with a minimum dielectric loss angle. The configuration of the coupling networks together with the excited striplines is accomplished by means of additive techniques or subtractive methods, preferably subtractive methods, preferably using PTFE or PET compositions, polyethylene compositions, poly-4-methylpentene or poly-4-methylhexene as the structure carrier.

Figure 11:
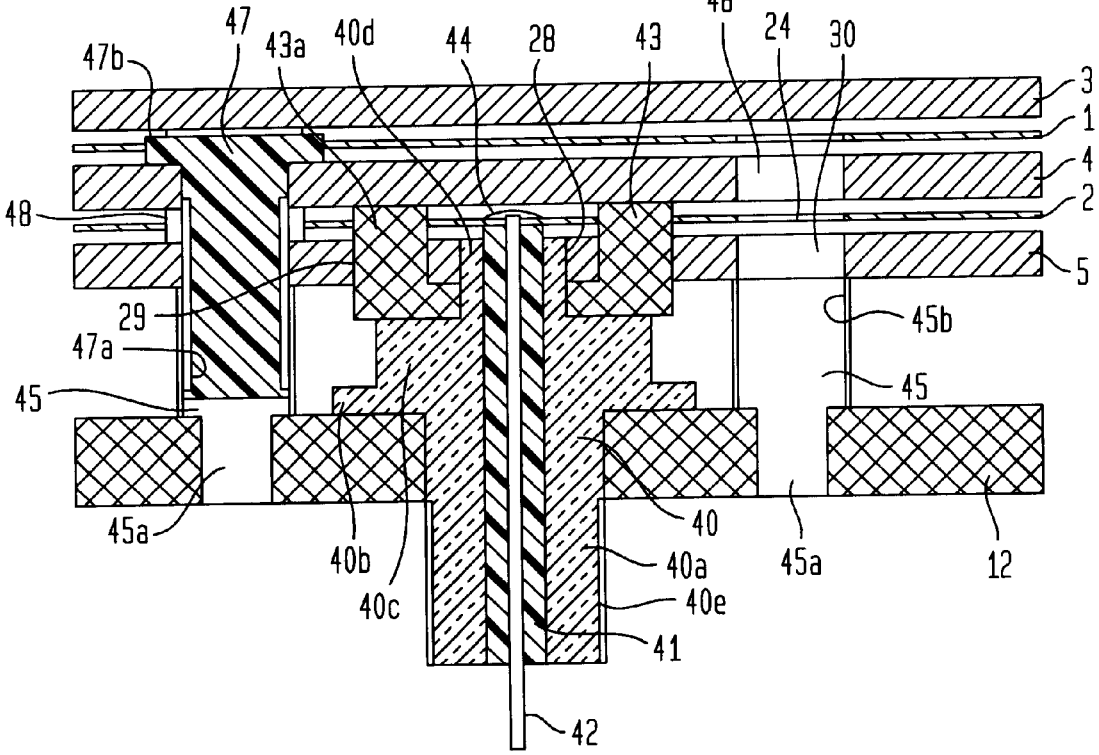
FIG. 11, 12: cross-sectional diagram through the coupling points between the coaxial waveguide and triplate network.

As shown in the figures, each coupling network 1 and 2 has trunk branches 13*a*, 13*b* (FIGS. 2 and 3) and 51 (FIG. 13), each of which connects half of the coupling network to the coupling point. Between the trunk branches 51, there is a linear stripline section 50 which serves to establish a galvanic connection between the planar array antenna and the downstream low-noise converter (LNC) (not shown) centrally with the central carrier wire 42 of a coaxial waveguide. The central carrier wire 42 which passes through conductor 50 is preferably galvanically connected to it by means of a solder connection. The stripline section 50 is bordered by two projections 43*a* of a spacer ring 43 at the same distance in each case. Projections 43*a* and 43*a'* connect the conductive layers 3 and 4 or 4 and 5 to one another in such a way as to form a hollow profile segment. This hollow profile segment is preferably rectangular, but it may also be circular or elliptical. The length of the stripline 50 is determined by the required impedance and the conduction conditions. As shown in FIG. 11, an external conductor part 40 is arranged on the baseplate 12 and it has a projection 40*a* extending through the baseplate in the direction of the low-noise converter. This external conductor part 40 may optionally be screwed to the baseplate 12. To do so, an outside thread is required on the external conductor part 40*a* in the area of baseplate 12, which in turn must have a matching inside thread. The external conductor 40 is in contact with baseplate 12 at its collar 40*b*. This collar 40*b* has a quadrilateral or hexagonal shape so it can work together with a wrench. In the direction of the conductive layers 3, 4, 5, a cylindrical part 40*c* in particular follows collar 40*b* and forms the contact surface for spacer ring 43 on its end face. Another cylindrical projection 40*d* with a smaller diameter follows the projection 40*c* forming the collar with a taper. Spacer ring 43 reaches around this projection 40*d*, which also passes for conductive layer 5, ending flush with its surface. The external conductor part 40 together with the central carrier wire 42 and the bushing 41 made of a nonconducting material form a coaxial waveguide for connection to the downstream low-noise converter.

Projection 40*a* passing through baseplate 12 has an outside thread for attaching the low-noise converter. The thickness of the baseplate 43*b* of the spacer ring 43 together with the length of the cylindrical part 40*c* and the length of the collar 40*b* together corresponds to the distance between the baseplate and the conductive layer 5. Additional spacer sleeves 45 keep the baseplate 12 and the conductive layer 5 at a distance. The conductive layers 4 and 5 are pressed together and held there by means of screws 47. Corresponding boreholes or recesses 46, 30 are provided for this purpose in the conductive layers 4 and 5. The network plane 2 also has a corresponding borehole 24.

Figure 12:
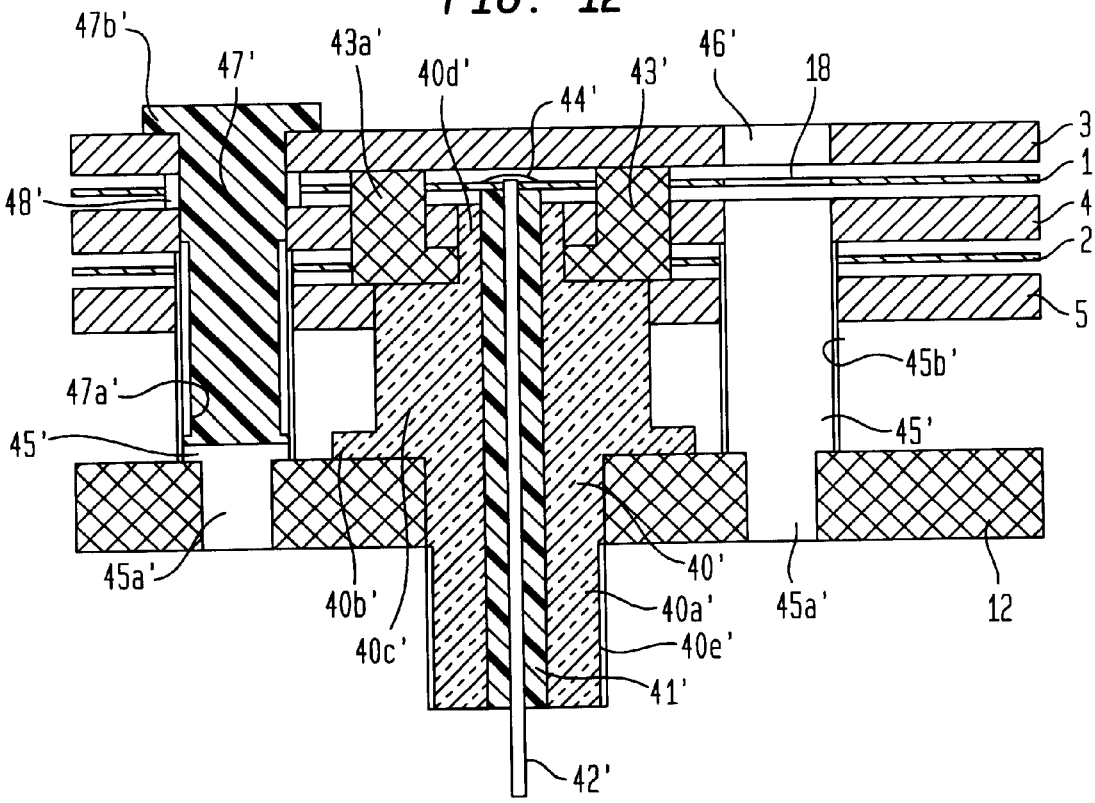

FIG. 12 shows the coupling between the coaxial waveguide and the triplate waveguide of network 1. For this purpose, the spacer ring 43' which is made of a conductive material connects the two conductive layers 3, 4 and also passes through the network plane 1. The conductive layers 3 and 4 are subjected to pressure with respect to one another by means of spacer bushings 45' and the respective screws 47'. The conductive external conductor part 40' connects the baseplate 12 to the spacer ring 43' in a conducting manner, so that baseplate 12 and the conducting layers 3, 4 are at the same potential. All the parts in FIG. 12 correspond in function to those shown in FIG. 11. Therefore, parts with the same function are labeled with the same reference notation, but with the added prime symbol (').

Relevant dimensions of the planar array antenna for receiving waves of the frequency range between approximately 10 GHz and 13 GHz are given below.

Figure 15:
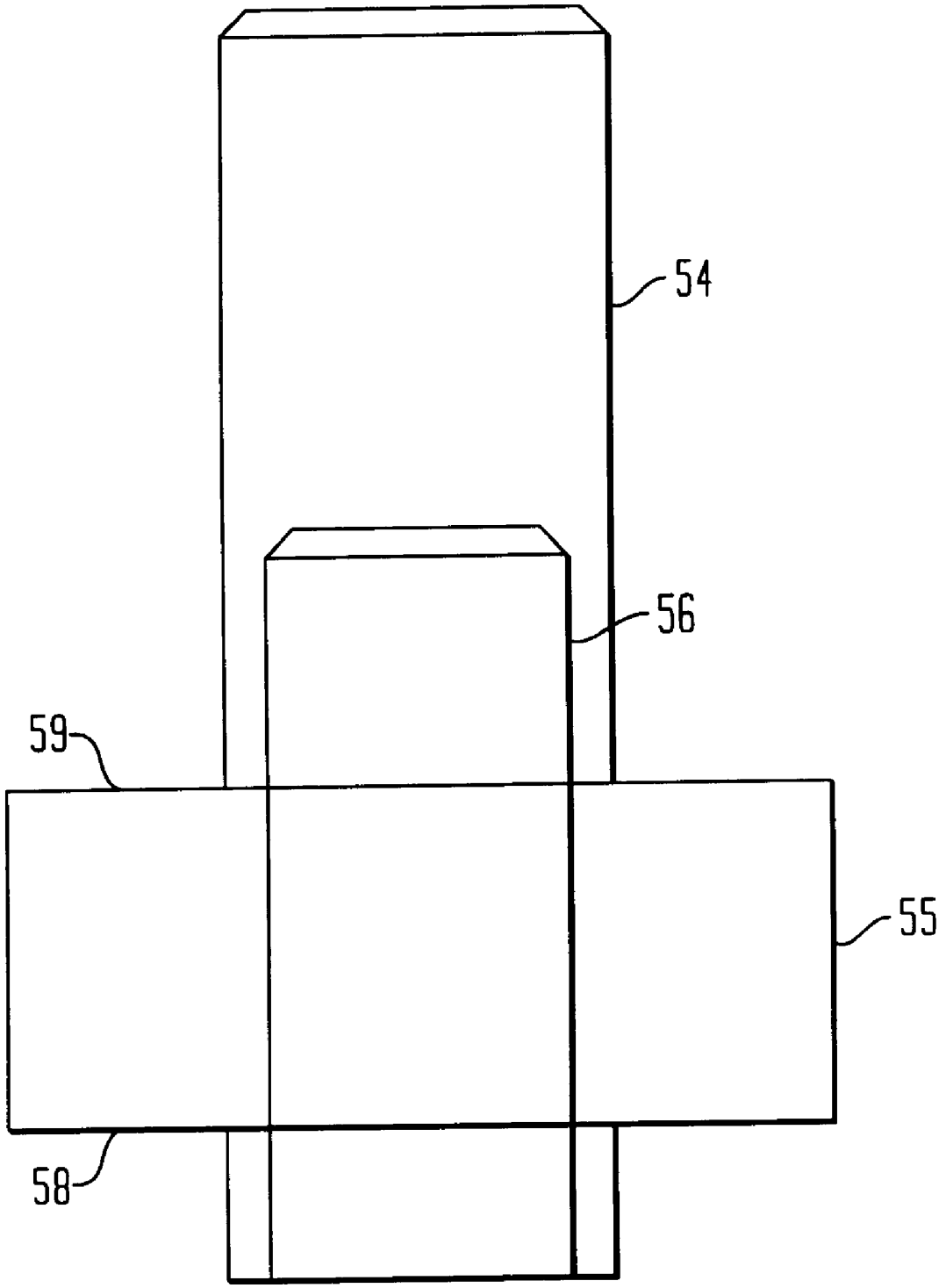
FIG. 15: guide bushing.

The distance between the baseplate 12 and the conductive layer 5 is 4 mm and is adjusted by the spacer bushings 45 and the guide bushings 54 according to FIG. 15 and the external conductor 40 together with the spacer ring 43. The interspace between the baseplate 12 and the conductive layer 5 is filled with a foam mat whose $\in_r$ value is approximately 1. A polyethylene foam film 1 mm thick is provided between a conductive layer 3, 4, 5 and the adjacent coupling network 1 or 2. The conductive layers are made of sheet aluminum 0.5 mm thick. A coupling network 1 or 2 which is arranged on an optionally fiberglass-reinforced PTFE film (TLY) or PET film with a relative dielectric constant of 2.2 and a thickness of 127 $\mu$m is provided between conducting layers 3, 4 and 5 with center symmetry.

Figure 13:
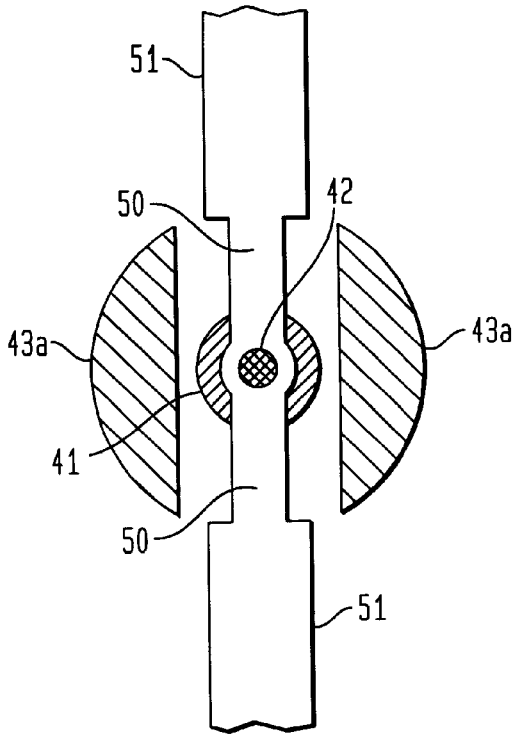
FIG. 13: top view of a coupling point.
Figure 14:
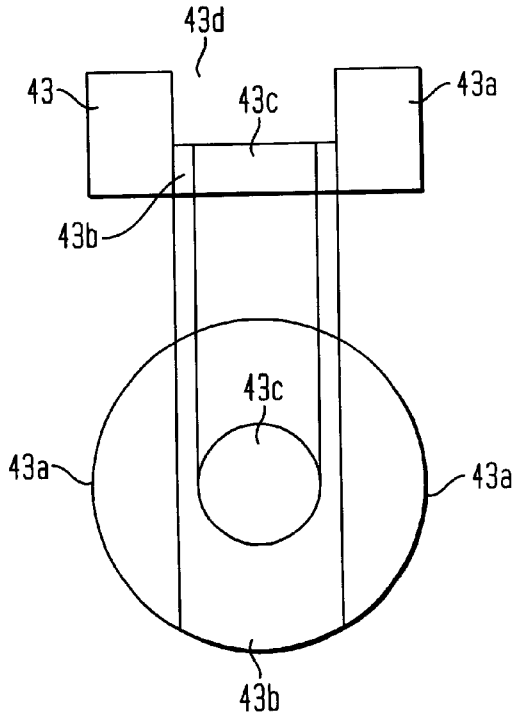
FIG. 14: a spacer ring to form the hollow profile segment.

Spacer ring 43 has an outside diameter of 12 mm. The inside diameter of the axial bore 43*c* is 5 mm. Groove 43*d* has a width of 6 mm. The width of the trunk branches 51 according to FIG. 13 is 2.1 mm, and the width of the stripline 50 is 1.2 mm. In the area of the galvanic solder connection between the central carrier wire 42 and stripline 50, stripline 50 is designed with thickened area, especially by means of circular segment sections with a radius of 0.85 mm. The height of baseplate 43*b* of spacer ring 43 is 2 mm. The height of the projections 43*a* is 2.625 mm. The slots have a width and length of 16 mm each. The corners are rounded, with the rounding corresponding to a circular segment with a radius of 5 mm. The center points of the slots 6 are spaced a distance of 21.5 mm apart from one another.

The excited striplines 16*a* for the horizontal plane have a length of 6 mm and a width of 1.5 mm. The distance between the two legs of the U-shaped connecting line 33 is 2.3 mm. The radius of the circular section is 1.15 mm. The distance from the edge 6*b* of a slot to the center line of the next leg 32, 34 is 1.6 mm. The length of branch 31*a* is 5 mm. The geometry of the radiator elements for the vertical plane differs only insignificantly from that of the radiator elements of the horizontal plane. The shape of the slot is the same. The length of the excited striplines 16*b* is 6 mm. However, the width of the excited striplines 16*b* is 1 mm.

It is self-evident that the size information given here is valid only for a certain frequency band and for materials that are selected accordingly. The geometries must be selected according to the required frequency spectrum of the planar array antenna.

| Notation: | |
|---|---|
| 1, 2 | coupling networks with excited striplines |
| 3, 4, 5 | conductive layers with slots 6 arranged in a matrix |
| 6, 6', 6" | slots |
| 6a | interspace between the slots |
| 6b, 6b', 6b" | edges of the slot |
| 7, 8, 9, 10, 11 | dielectric layers |
| 12 | baseplate |
| 13a, 14a, 13b, 14b | branches of the coupling network |
| 13a, 13b', 50 | trunk branch connected galvanically to the central carrier wire |
| 15, 15a, 15b, 31, 31a, 31b | branch to which the excited stiplines 16, 16', 16a, 16b are connected |
| 16, 16', 16a, 16b | excited striplines |
| 17, 22 | coupling point; galvanic connecting point between the central carrier wire and the trunk branch |
| 18, 24 | bores/recess for screws 47, 47' |
| 19a, 19b, 25 | bores for guide bushing 54 |
| 20, 23 | recesses for the projections 43a, 43a' of spacer ring 43, 43' passing through the coupling network |
| 21 | recess for the external conductor part 40' |
| 26 | bore for the cylindrical part 40d of the external conductor part 40' |
| 27 | bores for the spacer bushings 45' |
| 28 | bore for the cylindrical part 40d of the external conductor part 40 |
| 29 | bore for the projections 43a of spacer ring 43 passing through coupling network 2 |
| 30 | bores |
| 32, 34 | legs of the U-shaped connecting line |
| 33, 33a, 33b | U-shaped connecting line |
| 35, 36 | short connecting lines to the excited striplines |
| 40, 40' | external conductor part |
| 40a, 40a' | part passing through baseplate 12 |
| 40b, 40b' | part of the external conductor part in flat contact with the surface of baseplate 12 |
| 40c, 40c' | part forming the collar in contact with spacer ring 43, 43' |
| 40d, 40d' | additional collar of the external conductor passing through the conducting layer and ending flush with it |
| 40e, 40e' | outer thread for attaching coaxial waveguides or a low-noise converter |
| 41, 41' | insulating bushing between the central carrier wire 42, 42' and the external conductor 40, 40' |
| 42, 42' | central carrier wire |
| 43, 43' | spacer ring |
| 43a, 43a' | projections passing through the conductive layer and the coupling network, forming the side walls of groove 43d |
| 43b | baseplate of the spacer ring 43 |
| 43c | axial bore |
| 43d | groove forming the hollow profile segment |
| 44, 44' | solder connection between the central carrier wire 42, 42' and the trunk branch of the coupling network |
| 45, 45' | spacer, in particular a rivet bushing made of a conductive or nonconductive material |
| 45a, 45a' | section of the spacer 45, 45' driven into the baseplate |
| 45b, 45b' | inside thread of the spacer 45, 45' |
| 46, 46' | bore or recess for the conductive screw 47, 47' passing through |
| 47, 47' | screw made of a conductive or a nonconductive material |
| 47a, 47a' | outside thread of the screw 47 |

-continued

| Notation: | |
|---|---|
| 47b, 47b' | head of the screw 47 |
| 48, 49' | spacer element |
| 50 | linear stripline, arranged with center symmetry with the edges of the groove 43d of the spacer ring 43 formed by the projections 43a |
| 51 | trunk branches of the coupling network |
| 54 | guide bushing |
| 55 | section of the guide bushing with an enlarged diameter for adjusting the space between the baseplate and the conductive layer 5 |
| 56 | blind hole with an inside thread |
| 58 | contact surface on the baseplate 12 |
| 59 | contact surface on the conductive layer 5 |

What is claimed is:

1. A planar array antenna for sending and receiving linearly polarized waves, having two radiator planes arranged so they are plane parallel to one another, each of said two radiator planes having an array comprised of several radiator elements arranged in rows and columns, and said two radiator planes emit and receive waves polarized normal to one another, where said radiator elements of each radiator plane array are coupled to a central point in the same phase and amplitude by way of one coupling network for each array, said coupling network being comprised of a plurality of interconnected branches, where each radiator element has a slot (6) and a linearly excited stripline (16, 16', 16*a*, 16*b*), where said excited striplines (16, 16', 16*a*, 16*b*) are connected in groups of two to the ends of said branches (15, 31) of said coupling networks (1, 2), where the striplines (16, 16', 16*a*, 16*b*) of each group of two are arranged axially parallel to one another and connected to one end of a branch (15, 31) by at least one connecting line (32, 33, 34, 35, 36), wherein the length of the connecting line for one of the striplines in each group of two striplines is longer than the connecting line for the remaining stripline in the group of two striplines wherein the longer of the two connecting lines has a U shape with two parallel legs (32, 34), with the end of one leg (32) being connected to the branch (15, 31) of the coupling network (1, 2) and a short stripline (35) being connected to the end of the other leg (34) at a right angle, said short stripline being in turn connected to the excited stripline (16, 16', 16*a*, 16*b*) with the U-shaped connecting line being arranged between the two radiator elements (6, 16), wherein the difference in length of the two connected lines associated with each of said striplines in each of said group of two striplines results in a phase difference of 180 degrees between the two radiator elements formed by the group of two striplines and their associated slot.

2. The planar array antenna of claim 1, wherein said connecting lines in each group of two striplines differ from one another in length according to one half of a wavelength.

3. A planar array antenna according to claim 1, characterized in that a conductive layer (3, 4, 5) with slots (6) is arranged at a certain distance from each coupling network (1, 2) so they are plane parallel, with the slots (6) being arranged over a stripline (16, 16', 16*a*, 16*b*).

4. A planar array antenna according to claim 3, characterized in that at least one dielectric layer (7, 8, 9, 10) is arranged between the conductive layers (3, 4, 5) and the coupling networks (1, 2), and its thickness determines the distance between the conductive layer (3, 4, 5) and the coupling network (1, 2).

5. A planar array antenna according to claim 1, characterized in that the coupling network (1, 2) and the excited stripline (16, 16', 16*a*, 16*b*) are applied to a PTFE or PET film, especially such a film reinforced with fiberglass.

6. A planar array antenna according to claim 1, characterized in that the excited striplines (16, 16', 16*a*, 16*b*) of one row are arranged in a line or so that they are axially parallel to one another, with these strips conductors (16, 16', 16*a*, 16*b*) being connected to the coupling network (1, 2) alternately at their first narrow end face and at their second narrow end face.

7. A planar array antenna according to claim 1, characterized in that the waveguides of the planar array antenna are designed in the triplate technique.

8. A planar array antenna according to claim 1, characterized in that each coupling network (1, 2) has an input point and an output point (17, 22), with the coupling points (17, 22) being designed as waveguide junctions between triplate technique and coaxial input and output.

9. A planar array antenna according to claim 1, characterized in that the slots (6) are rectangular, in particular square, with or without rounded or beveled corners (6*c*, 6*c'*), where the radius of the rounded corners or the degree of beveling determines the frequency band width and the input impedance.

10. The planar array antenna of claim 1, wherein the contour of the slots (6) has a number n of straight sides (6, 6*b'*, 6*b''*) connected to one another by arcs.

11. The planar array antenna of claim 1, wherein the bordering of the slots (6) is composed of a number of segments n chosen from the group consisting of circular, elliptical and hyperbolic.

12. The planar array antenna of claim 1, wherein an excited stripline (16, 16', 16*a*, 16*b*) projects into a slot (16), with said stripline (16, 16', 16*a*, 16*b*) being arranged perpendicular to the slot side beyond which it proiects into the slot (6).

13. The planar array antenna of claim 1, wherein the excited striplines (16, 16', 16*a*, 16*b*) of two adjacent slots (6) arranged in rows are arranged in alternation, starting from opposite edges (6*b*, 6*b'*, 6*b''*) and leading into the slot (6).

14. The planar array antenna of claim 12, wherein said linear striplines (16, 16', 16*a*, 16*b*) within the slot are formed by several linear stripline sections having variable lengths and widths.

15. The planar array antenna of claim 12, wherein the striplines designed in sections are made of conductor sections linked together by means selected from the group consisting of galvanical means and by means of a gap having a defined gap width.

16. The planar array antenna of claim 12, wherein the excited striplines (16, 16', 16*a*, 16*b*) are arranged in a manner selected from the group consisting of having center symmetry and being offset with respect to the bordering side of the respective slot.

17. The planar array antenna of claim 12 wherein a central coupling point (17, 22) is designed so that a central carrier wire (42, 42') of a coaxial waveguide, by means of which signals are input and output from the planar array antenna to a low-noise converter (LNC), is galvanically connected to the stripline section of the coupling network (1, 2) which forms a trunk branch (51), and a stripline segment (15) leads in a straight line and with center symmetry through a conductively bordered and profiled hollow profile segment in the area of the galvanic connection to the central carrier wire (42, 42').

18. The planar array antenna of claim 17, wherein a hollow profile segment is formed by a conductive connection between the conductive layers (3, 4, 5) having the coupling network (1, 2), including the slots (6), and the conductive layers themselves.

19. The planar array antenna of claim 18, wherein a spacer ring (43, 43') which forms the hollow profile segment connects the two conductive layers (3, 4; 4, 5) to one another in a conductive manner by means of integrally molded projections (43*a*, 43*a'*) having a defined length provided on its first flat side, and said spacer ring (43, 43') is supported with its second flat side on a collar (40*c*, 40*c'*) of the part (40, 40') forming the external conductor of the coaxial waveguide, said projections (43*a*, 43*a'*) passing through one conductive layer (4, 5) and the coupling network (1, 2) and abutting against the other conductive layer (3, 4).

20. The planar array antenna of claim 19, wherein the spacer ring (43, 43') extends around a cylindrical projection (40*d*, 40*d'*) adjacent to a collar (40*c*, 40*c'*) of the external conductor (40, 40'), and said cylindrical projection (40*d*, 40*d'*) passes through a conductive layer (4, 5) and ends flush with its surface.

21. The planar array antenna of claim 19, wherein the spacer ring (43, 43') is a disc with an axial bore (43*c*) in whose one flat side there is a groove (43*d*) arranged with center symmetry, its depth corresponding to the length obtained by adding the thickness of the one conductive layer (4, 5) and the distance between the two conductive layers (3, 4; 4, 5).

22. The planar array antenna of claim 19, wherein the part (40, 40') which forms the external conductor has another collar (40*b*, 40*b'*) which is in contact with a conductive baseplate (12).

23. The planar array antenna of claim 19, wherein the part (40, 40') which forms the external conductor has an axial bore in which a nonconductive bushing (41, 41') made of PTFE is inserted, with the central carrier wire (42, 42') arranged inside it, with the bushing abutting at one end face against the lower side of the coupling network (1, 2).

24. The planar array antenna of claim 3, wherein conductive layers (3, 4, 5) having a baseplate (12) and the slots (6) are kept at a distance by means of conductive spacer pieces, in particular rivet bushings which are driven into the baseplate (12) with the spacer pieces (45, 45') having an inside thread (45*b*, 45*b'*) in which screws (47, 47') engage, with a conductive layer (3, 4) being acted upon by pressure against the spacer ring (43, 43') by means of the screws (47, 47') with their heads.

25. A planar array antenna for sending and receiving linearly polarized waves of only one plane of polarization comprised of a single radiator plane having an array comprised of several radiator elements arranged in rows and columns, where said radiator elements are coupled to a central point in the same phase and amplitude by way of a coupling network, said coupling network being comprised of a plurality of interconnected branches where each radiator element has a slot (6) and a linearly excited stripline (16, 16', 16*a*, 16*b*), where said excited striplines (16, 16', 16*a*, 16*b*) are connected in groups of two to the ends of said branches (15, 31) of said coupling network, where the striplines (16, 16', 16*a*, 16*b*) of each group of two are arranged axially parallel to one another, and connected to one end of a branch (15, 31) by at least one connecting line (32, 33, 34, 35, 36), wherein the length of the connecting line for one of the striplines in each group of two striplines is longer than the connecting line for the remaining stripline in the group of two striplines wherein the longer of the two connecting lines has a U shape with two parallel legs (32, 34), with the end of one leg (32) being connected to the branch (15, 31) of the coupling network (1, 2) and a short stripline (35) being connected to the end of the other leg (34) at a right angle, said short stripline being in turn connected to the excited stripline (16, 16', 16*a*, 16*b*) with the U-shaped connecting line being arranged between the two radiator elements (6, 16), wherein the difference in length of the two connected lines associated with each of said striplines in each of said group of two striplines results in a phase difference of 180 degrees between the two radiator elements formed by the group of two striplines and their associated slot.

26. The planar array antenna of claim 25, wherein circular polarization can be sent and received by means of a polarizer arranged over the planar array antenna in radiation space.

* * * * *